US005575018A

United States Patent [19]

Rothrock

[11] Patent Number: 5,575,018

[45] Date of Patent: Nov. 19, 1996

[54] OPEN COCKPIT RACING HELMET

[75] Inventor: Ed Rothrock, Whittier, Calif.

[73] Assignee: Bell Sports, Inc., Cerritos, Calif.

[21] Appl. No.: 233,074

[22] Filed: Apr. 26, 1994

[51] Int. Cl.[6] ..... A42B 3/00

[52] U.S. Cl. ..... 2/424; 2/425

[58] Field of Search ..... 2/410, 411, 424, 2/425, 422, 171.3

[56] References Cited

U.S. PATENT DOCUMENTS

| | | | |
|---|---|---|---|
| 3,548,410 | 12/1970 | Parker | 2/424 |
| 3,578,264 | 5/1971 | Kuethe | 244/41 |
| 3,741,285 | 6/1973 | Kuethe | 165/1 |
| 3,766,363 | 12/1973 | Kuethe | 181/33 C |
| 4,075,714 | 2/1978 | Ryder et al. | 2/6 |
| 4,564,959 | 1/1986 | Zahn | 2/411 |
| 4,903,350 | 2/1990 | Gentes et al. | 2/421 |
| 5,014,366 | 5/1991 | Discipio, Sr. | 2/424 |
| 5,023,958 | 6/1991 | Rotzin | 2/411 |
| 5,097,538 | 3/1992 | Feuling | 2/410 |
| 5,165,116 | 11/1992 | Simpson | 2/424 |
| 5,271,102 | 12/1993 | Feuling | 2/410 |

FOREIGN PATENT DOCUMENTS

| | | | |
|---|---|---|---|
| 131929 | 1/1985 | European Pat. Off. | 2/410 |
| 2676336 | 11/1992 | France | A42B 3/00 |
| 3305735 | 8/1984 | Germany | 2/410 |
| 24083 | 5/1988 | Japan | 2/411 |
| 2048056 | 12/1980 | United Kingdom | 2/410 |
| 8703457 | 6/1987 | WIPO | 2/424 |

OTHER PUBLICATIONS

Monarch Helmets advertisement for AeroHawk® motorcycle helmet, date unknown.

1993 Bell Auto Racing Helmets Catalog.

*Primary Examiner*—Michael A. Neas
*Attorney, Agent, or Firm*—Ladas & Parry

[57] ABSTRACT

The helmet of the present invention comprises an air deflector or boundary layer control device disposed over the top and sides of the helmet's outer shell. In the preferred embodiment the air deflector is a wicker formed of a strip of rubber or a similar material, which is disposed along the top and sides of the outer shell of the helmet. The helmet of the present invention also comprises a spoiler disposed along the bottom of the front and sides of the helmet's outer shell. The wicker and spoiler interact with the air flowing by the helmet at high speeds to reduce the effects of lift, thrust, pitch and buffeting on the helmet.

9 Claims, 4 Drawing Sheets

OPEN COCKPIT RACING HELMET

BACKGROUND OF THE INVENTION

This invention relates to helmets, particularly to helmets worn by drivers in open cockpit racing vehicles.

Helmets in various forms have been used throughout history to protect their wearer's heads. Full head helmets, replete with flip up face shields or visors have been famous since at least as early as the time European knights travelled about on horse back.

In addition to providing protection for the wearer's head, helmets have also been worn for aesthetic effect. In automobile racing aesthetics obviously take a back seat to the function of protecting the driver's head.

Other functions are also important, particularly in open cockpit racing such as Indianapolis 500 and Formula One style races. In such races, during which speeds greatly exceed 100 miles per hour, and sometime exceed 200 miles per hour, and in which a fraction of a second can be the difference between winning and losing, an important factor is aerodynamic drag (i.e., the resisting force exerted by air on a vehicle, which force tends to retard the vehicle's motion). We are all familiar with the recent efforts of designers of passenger automobiles to make their cars sleeker to reduce aerodynamic drag. Efforts in this regard are taken to much further lengths by designers of automobiles which are used solely for racing, since they are not constrained by the need to take into account making room for several passengers, child seats, groceries, and brief cases as passenger automobile designers must.

To reduce aerodynamic drag upon racing cars, designers have over the years reduced the size of the car chassis. As a result, in recent racing car designs, the driver's helmet has become more exposed to the effects of the air flowing through the cockpit area of the car. To the extent that the helmet is exposed to air flow, the helmet contributes to the aerodynamic drag exerted on the racing car and its contents (including the driver). In a field in which speed is so important, no ingredient which may reduce speed may be overlooked.

Also, to the extent that any aerodynamic drag is exerted on a helmet, the driver's head will be pushed back. A stop may be placed behind the driver's head, to reduce the strain on the driver's neck and shoulders that aerodynamic drag might create.

Modern helmets have been designed to reduce the drag force exerted on helmets. However, the configurations of some race cars and some prior art helmets, and the effect they have on the air flow path, potentially could result in an opposite force being exerted by the air flow on the helmets. That force, called thrust, causes the helmet, and the driver's head to which it is strapped, to be pulled forward. While the thrust force could be relatively low, it would be difficult, if not impossible to position an appropriate stop in the cockpit of a racing car to help the driver's efforts to keep the driver's head in its proper position. As a race goes on, the stress on the driver's neck and shoulders associated with the efforts to overcome thrust can cause severe discomfort for the driver.

Another aerodynamic force exerted on the helmet is lift. The helmet is pulled upward as a result of the air flowing around the helmet. This force also results in significant stress to the driver's neck and shoulders during a race.

Generally speaking, lift increases in proportion to the square of the increase in velocity of the car. So, as racing cars increase in speed, lift on a helmet becomes significantly more pronounced.

The air flow around the helmet also causes the helmet to pitch upward about the helmet's lateral axis (the axis perpendicular to both vertical and the longitudinal axis of the car), so that the front of the helmet tends to rise while the rear of the helmet tends to drop. This causes the driver's head to pitch as well, and also causes the helmet to tend to rotate relative to the driver's head. As a result, the driver endures additional stress and discomfort.

The foregoing problems are not the only ones causes by aerodynamic forces. The flow of air is not constant, instead it is quite turbulent. This turbulence causes the helmet to be subjected to fore and aft and side to side accelerations, or buffeting, and constitutes a further ingredient to a race car driver's strain and discomfort.

Under ideal circumstances, a helmet would have a neutral effect while being worn by a driver during a race. Even if a helmet had no direct effect on the performance of the race car (as discussed above, drag on a helmet can slow down the race car), stress and discomfort caused to the driver by aerodynamic effects may eventually result in a slower race being driven by the driver. In a worst case scenario, a driver's fatigue due to aerodynamic forces on the helmet could lead to a crash.

The helmet of the present invention reduces thrust, lift, pitch, and buffeting effects, and can be adjusted to accommodate various driver and race car combinations.

SUMMARY OF THE INVENTION

The helmet of the present invention comprises an air deflector or boundary layer control device disposed over the top and sides of the helmet's outer shell. In the preferred embodiment the air deflector is a wicker formed of a strip of rubber or a similar material, which is disposed along the top and sides of the outer shell of the helmet. The helmet of the present invention also comprises a spoiler disposed along the bottom of the front and sides of the helmet's outer shell. The wicker and spoiler interact with the air flowing by the helmet at high speeds to reduce the effects of lift, thrust, pitch and buffeting on the helmet.

DETAILED DESCRIPTION OF THE INVENTION

Figure 1:
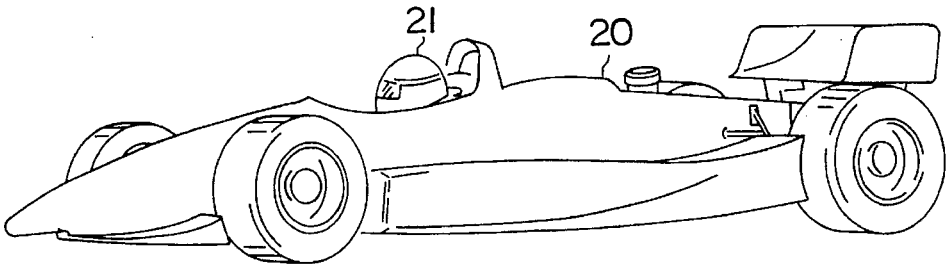
FIG. 1 PRIOR ART
FIG. 1 is a perspective view of a race car with a driver wearing a prior art helmet.

The preferred embodiments of the invention are illustrated in the attached drawings which are referred to herein. The same reference numeral will be used to identify identical elements throughout the drawings.

FIG. 1 illustrates a race car 20 in which a driver is sitting wearing a prior art helmet 21.

Figure 2:
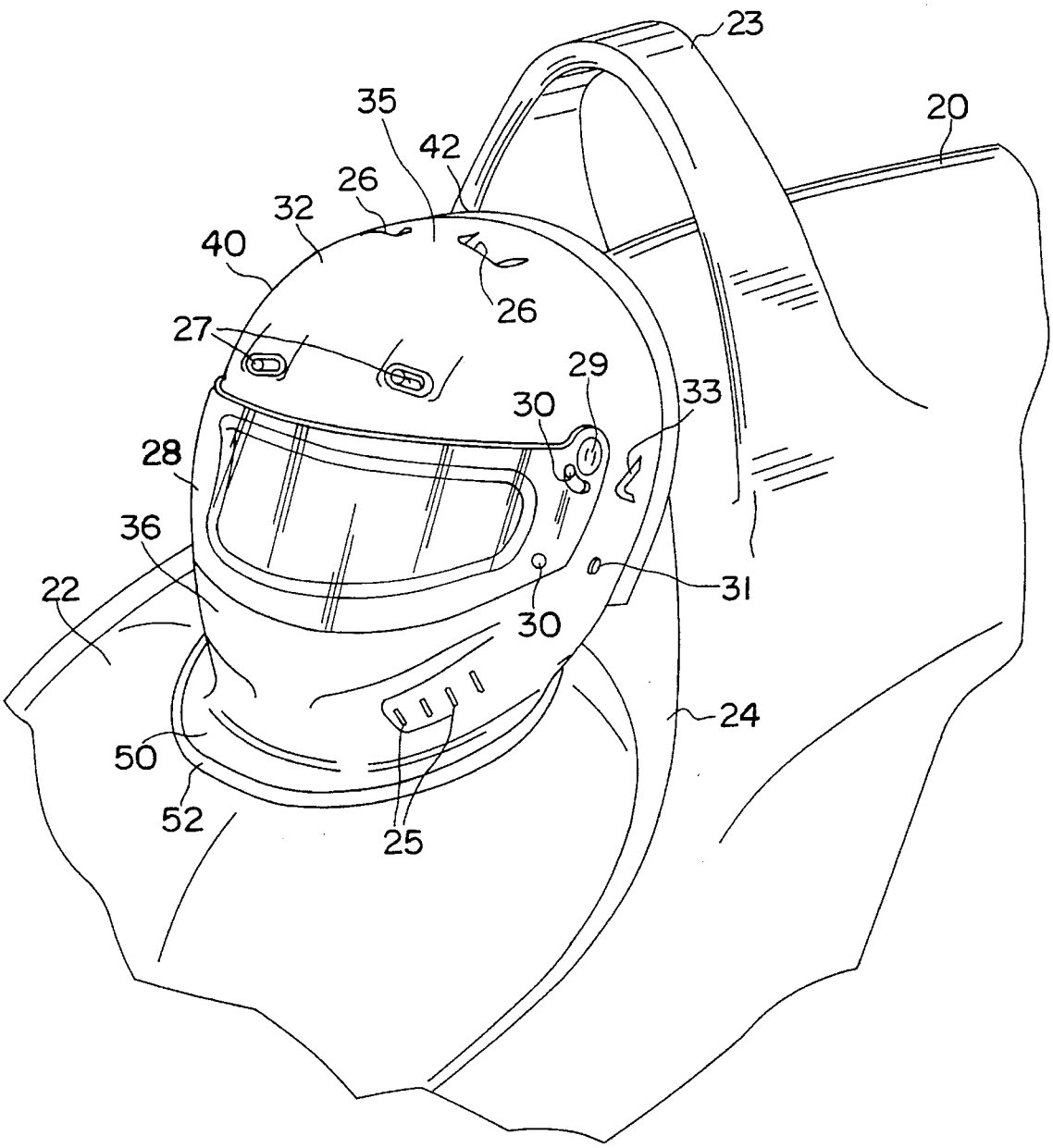
FIG. 2 is a perspective view of the helmet of the present invention shown as worn by a driver in a racing car.

FIG. 2 illustrates driver 22 sitting in front of roll loop 23 in the open cockpit 24 of racing car 20, wearing helmet 40 of the present invention.

A standard feature in virtually all modern racing helmets is an outer shell 32, which includes a top 35, front 36, rear 37, and left and right sides 38 and 39. (See FIGS. 2–5.) These elements correspond to the crown, face, rear and left and right sides, respectively, of the wearer's head. Other features standard in most racing helmets include air inlet vents 25 and 27 located in positions corresponding to the sides of the driver's lower jaw and forehead, respectively and, air outlet vents 26 located in a position corresponding to the crown of the driver's head. The purpose of these vents is to provide ventilation to the driver. The supplemental air vents 27 may be opened and closed by the driver at any time to suit the driver's comfort needs.

Other standard features include visor 28 which is hingedly mounted on the helmet by a left and right mounting members 29, and which is held in place in an open or closed position by stops 30, and left and right lugs 31, which bolt the helmet's chin strap to the helmet's outer shell 32. Some prior art helmets also comprise a raised V-shaped member 33 on each of the left and right sides of the helmet's outer shell. These V-shaped members have been useful in reducing fore and aft and side to side buffeting forces exerted on prior art helmets. However, the present invention has substantially reduced such forces and the V-shaped member has not provided any significant reduction in such buffeting forces on the helmet of the present invention beyond that provided by the present invention itself. Thus the provision of the V-shaped member is optional when incorporating the features of the present invention into a helmet.

Referring to FIGS. 2–6, 8 and 9, an air deflector or boundary layer control device 42 is shown disposed along the top and sides of the helmet's outer shell. In the preferred embodiment the air deflector is a wicker which is flexible and is removably mounted on the helmet's outer shell. It has been found that the advantages of the present invention are best obtained if the wicker is disposed closer to the rear of the outer shell than to the front (i.e., at a point corresponding to a location behind the center of the driver's head.) In the embodiment shown in FIGS. 2–6, the wicker is placed just forward of the line at which the top and sides of the helmet's outer shell begin a steep inward slope toward the rear of the helmet.

Figure 6:
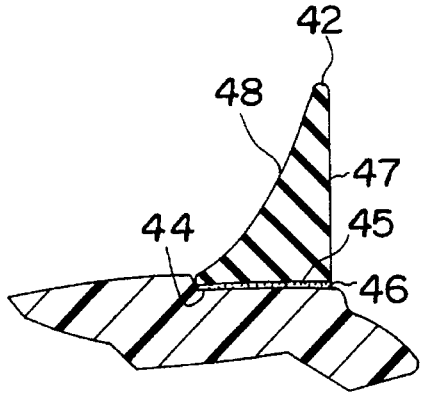
FIG. 6 is a cross-sectional view of a portion of the helmet taken along line 6—6 of FIG. 3.
Figure 7:
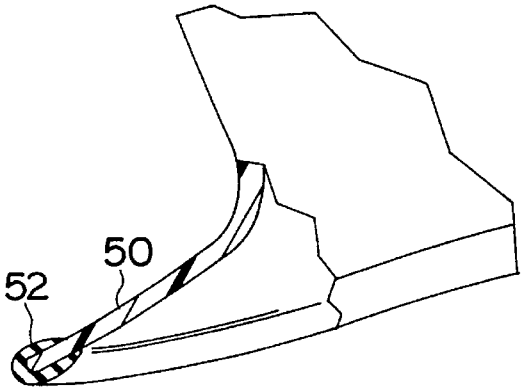
FIG. 7 is a magnified, cross-sectional view of the portion of the helmet indicted by line 7 of FIG. 3.

As shown in FIG. 6 in the preferred embodiment the outer shell of the helmet is provided with a shallow recess 44 in which the wicker is disposed.

The wicker is preferably made of a strip of rubber or other similar material. The wicker is bonded to the outer shell of the helmet by an adhesive, such as rubber cement 46.

The bottom edge or base 45 of the wicker is approximately ½ inch from front to back. Its posterior edge 47 rises up at substantially a right angle to the bottom edge, and may range from less than 50 thousandths of an inch in height to over ½ inch in height. In the preferred embodiments, wickers having heights of 0.25 inch, 0.30 inch and 0.46 inch have been used.

The slope of the connecting surface 48 of the wicker, which connects the front of the bottom edge with the top of the posterior edge, may be concave as shown, or straight or convex.

Wicker 42 interacts with the flow of air such that a downward force on the wicker is created, which is then imparted to 'the outer shell of the helmet and counters the lift which the flow of air otherwise imparts to the helmet. The wicker 42 also interacts with the air flow to create drag to counteract any thrust which might be imparted to the helmet by the air flow. In addition, the wicker helps reduce both fore and aft and side to side buffeting nominally imparted to prior art helmets by the turbulence created in the air flow as it passes through and out of the cockpit. The downward force and the drag imparted to the wicker increases as the height of the posterior edge increases. The downward force and drag imparted to the wicker are smallest when slope of the connecting surface 48 is convex, and greatest when it is concave.

Figure 3:
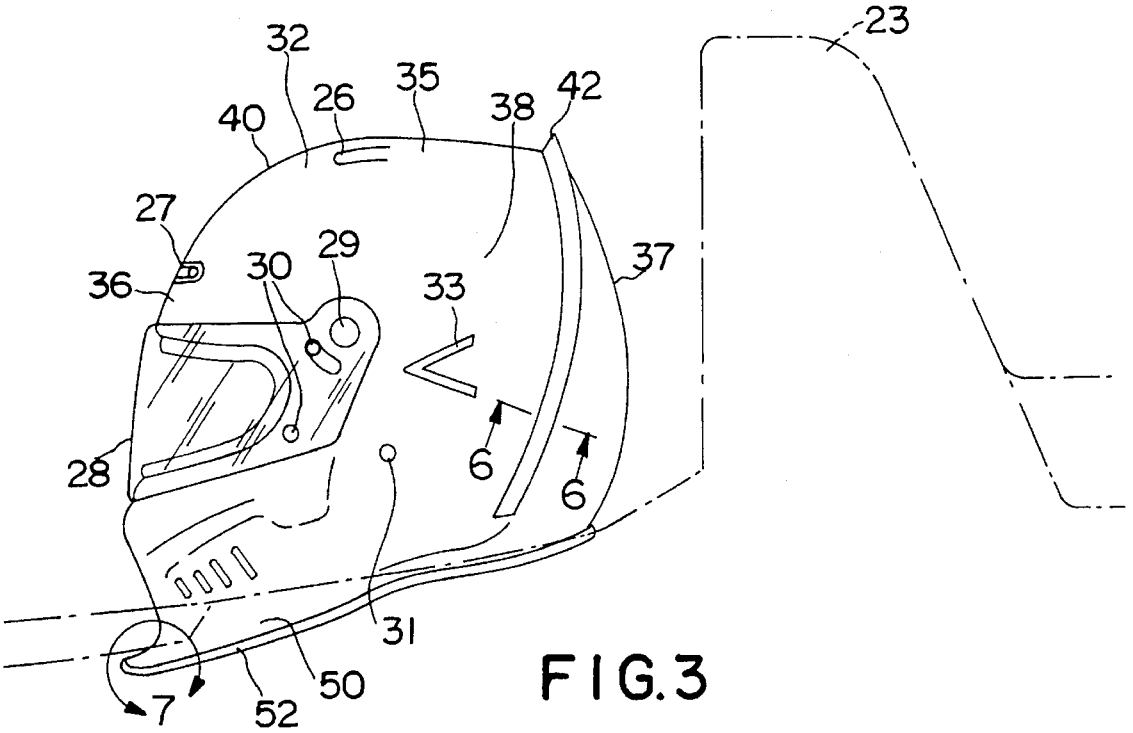
FIG. 3 is a left side elevational view of the helmet of the present invention, shown in relationship to a portion of a racing car illustrated in phantom lines.
Figure 4:
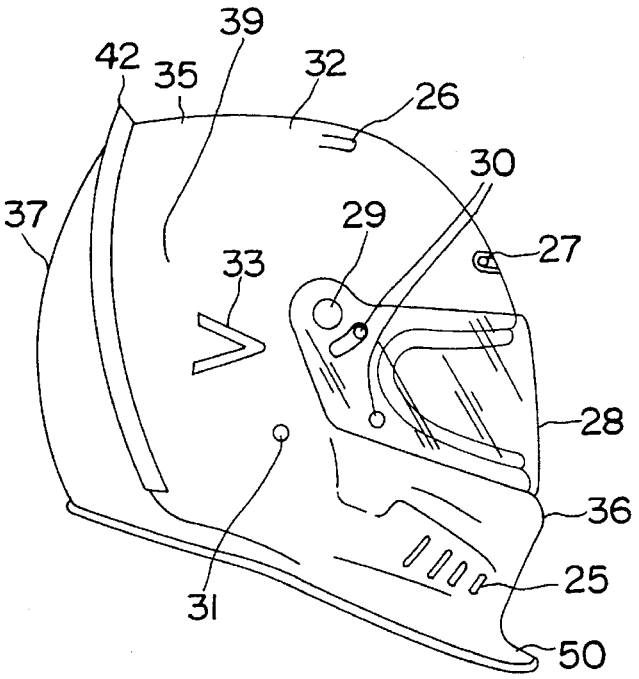
FIG. 4 is a right side elevational view of the helmet of the present invention.
Figure 5:
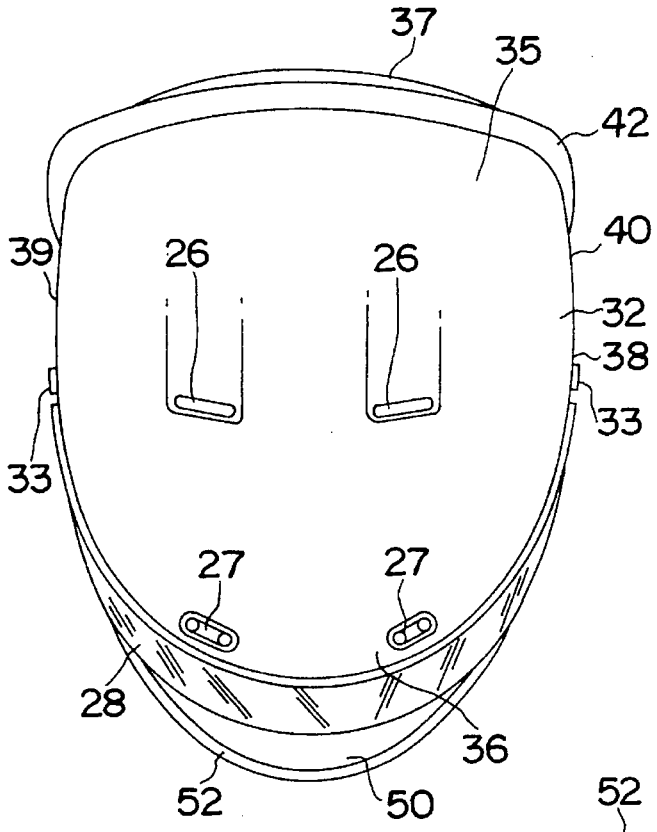
FIG. 5 is a top plan view of the helmet of the present invention.

As shown in FIG. 3, wicker 42 does not extend down to the lowest part of the helmet. If the wicker extends that far down, there would tend to be an increase in lift. In the preferred embodiment of the invention the lower rear surface of the outer shell of the helmet is maintained smooth so that the air flow along the lower portion of the helmet has a low resistance path along which to pass the helmet and exit the cockpit.

An outwardly extending chin spoiler 50 is formed at the lower front of the helmet and extends around to the sides of the helmet to a point corresponding to the back of the lower jaw of the driver. The chin spoiler interacts with the air flow, particularly the downward flow of air which passes by visor, to reduce lift on the helmet and also to reduce the tendency of the helmet to pitch upward. The length of the spoiler (i.e., the distance from the spoiler's junction with the outer shell to the outer rim of the spoiler) is greatest at the front of the helmet and then tapers to zero along the sides of the helmet. The larger the spoiler and the smaller the angle that the spoiler makes to horizontal when the driver's head is maintained level, the greater is the reduction in lift and pitch that is obtained. In the preferred embodiment, the chin spoiler is formed out of the same material and is integral with the outer shell of the helmet. In the preferred embodiment, the length of the chin spoiler at the front of the helmet is about 2 inches, and the spoiler is angled 20° below horizontal.

Figure 9:
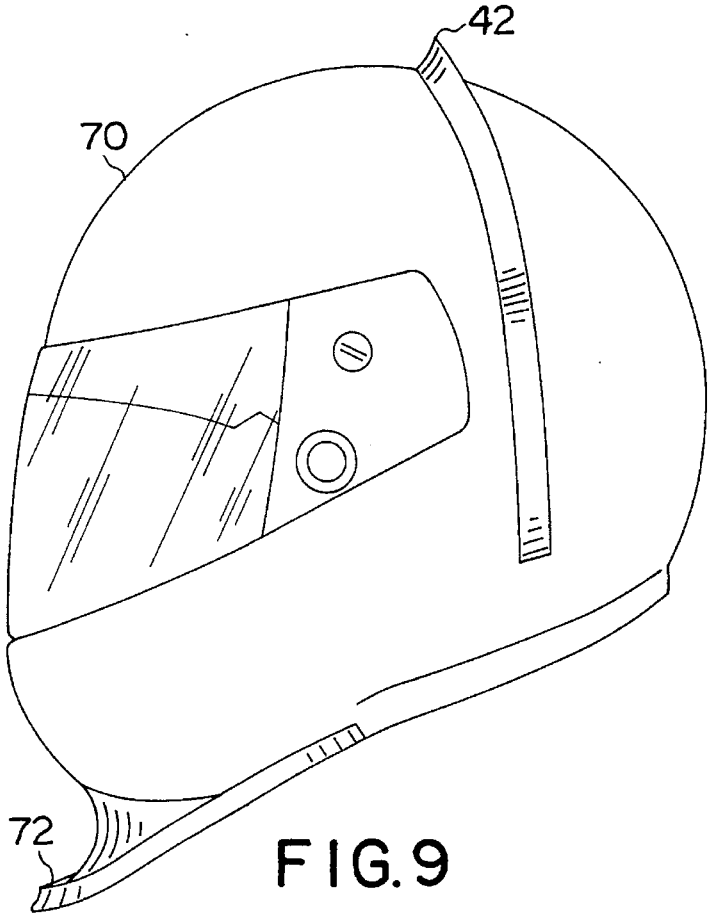
FIG. 9 is a side elevational view of the helmet shown in FIG. 8.

A modified wicker 52 may be disposed on the outer edge of the chin spoiler as shown in FIGS. 2–5 and 7. A wicker 72 having the same contours as wicker 42, may be placed on the upper surface of the outer edge of the chin spoiler as shown in FIG. 9. Placing a wicker along the outer edge of the chin spoiler tends to further reduce lift.

Figure 8:
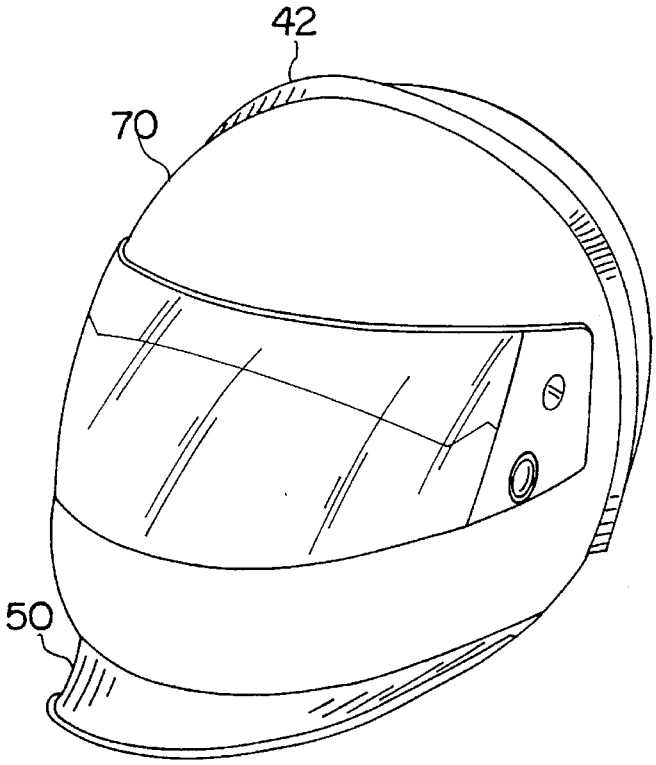
FIG. 8 is a perspective view of another embodiment of the helmet of the present invention.

The embodiment of the invention shown in FIGS. 8 and 9 is presented principally to illustrate that the present invention may be used in connection with helmets having various shapes. Whereas the helmet shown in FIGS. 2–7 is somewhat square when viewed from the side, the helmet 70 of FIGS. 8 and 9 has an outer shell with a top, front, rear and left and right sides so configured that the helmet is spherical.

An important feature of the present invention is that substantial adjustments can be made to the helmet to fine tune it to the particular driver wearing it and the racing car in which the driver is driving. The ability to fine tune the helmet of the present invention is a great advantage over prior art helmets because the thrust, lift, pitch and buffeting effects of air flow on a helmet used in particular racing car change with each driver, depending upon many variables including the driver's height, weight and build. In addition such effects on a helmet worn by a particular driver change with each racing car, depending upon the car's particular contours.

For example, if the original wicker disposed over the top of the helmet has only a 0.25 inch height and the driver after a test run experiences too much lift or thrust, the wicker may be removed and replaced with a wicker having a greater height. If after a trial run the driver feels that the helmet is pitching downward, the chin spoiler may be trimmed back. The wicker over the top of the helmet may be moved forward or backward, and its length may be varied so that the extent to which it extends down the sides of the helmet towards its bottom may be changed. All of these adjustments, as well as other adjustments, may effect the lift, thrust, drag, pitch and buffeting forces on the helmet, and the adjustments would normally be made until the driver feels that the helmet sits neutrally on the driver's head.

Above there has been described a unique helmet. It should be understood that various changes of the details, materials, arrangements of parts and uses which have been herein described and illustrated in order to explain the nature of the invention will occur to and may be made by those skilled in the art upon their reading of this disclosure, or upon their seeing an embodiment of the invention described herein, and such changes are intended to be included within the principles and scope of the invention.

I claim:

1. A helmet for the protection of a wearer's head, said helmet comprising an outer shell, said outer shell having a top, a front, a rear, and left and right sides corresponding to the head's crown, face, rear and left and right sides, respectively, said helmet further comprising a first air deflector formed of a strip of flexible material having a substantially triangular cross-section with a base which is disposed on said outer shell, and an upstanding edge which extends up from and substantially perendicularly away from said base, said first air deflector being disposed on the top and left and right sides of the outer shell, wherein the upstanding edge of said strip is disposed toward the rear of said outer shell, and wherein the front of said outer shell comprises a lower portion corresponding to the chin and lower jaw of the wearer's head, said helmet further having a said front extending outward from said lower portion of said front of said outer shell, wherein the length of the spoiler from its outer rim to its juncture with said outer shell is greatest at the most forward part of the lower portion of said front of said outer shell, and a second air deflector disposed on said spoiler.

2. The helmet of claim 1 wherein said strip of which said first air deflector is formed is a first strip and wherein said second air deflector is formed of a second strip of flexible material having a substantially triangular cross-section with a base which is disposed on said spoiler, and an upstanding edge which extends up from and substantially perpendicularly away from said base of said second strip, wherein the upstanding edge of said second strip is disposed toward the rear of said outer shell.

3. The helmet of claim 1 wherein said spoiler extends around to the sides of said outer shell.

4. The helmet of claim 1 wherein said length of said spoiler tapers toward the rear of said outer shell.

5. The helmet of claim 1 wherein said spoiler is integral with said outer shell.

6. The helmet of claim 1 wherein said first air deflector is removably attached to the outer shell.

7. The helmet of claim 1 wherein said second air deflector is removably attached to the spoiler.

8. A helmet comprising an outer shell having a top, a front, a rear, and left and right sides, each of said front and said left and right sides having a lower portion, said helmet further comprising a first strip of flexible material disposed across the top and down the sides of said outer shell, a spoiler extending out from the lower portion of the front and sides of said outer shell, and a second strip of flexible material having a substantially triangular cross-section with a base which is disposed on said spoiler, and an upstanding edge which extends up from and substantially perpendicularly away from said base of said second strip, wherein the upstanding edge of said second strip is disposed toward the rear of said outer shell.

9. The helmet of claim 8 wherein at least one of said first and second strips of flexible material is removably attached to the helmet.

* * * * *